US006908078B2

(12) United States Patent
Suzuki et al.

(10) Patent No.: US 6,908,078 B2
(45) Date of Patent: Jun. 21, 2005

(54) SHEET PROCESSING WITH SHEET INSERTING DEVICE

(75) Inventors: Toshimasa Suzuki, Chiba (JP); Wataru Kawata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/428,839

(22) Filed: May 5, 2003

(65) Prior Publication Data

US 2003/0214091 A1 Nov. 20, 2003

(30) Foreign Application Priority Data

May 14, 2002 (JP) ..... 2002-139130

(51) Int. Cl.[7] ..... B65H 39/00

(52) U.S. Cl. ..... 270/15; 270/17; 270/58.07; 270/58.17; 270/58.23; 270/58.27; 271/221; 271/223; 400/625

(58) Field of Search ..... 400/625; 271/220, 271/221, 223; 270/1.01, 12, 15, 17, 58.01, 58.07, 58.17, 58.23, 58.26, 58.27, 58.11, 58.12, 59

(56) References Cited

U.S. PATENT DOCUMENTS

| | | | | | |
|---|---|---|---|---|---|
| 4,524,268 | A | * | 6/1985 | Fukatsu | 235/379 |
| 5,104,105 | A | * | 4/1992 | Cote et al. | 270/1.02 |
| 5,147,092 | A | * | 9/1992 | Driscoll et al. | 271/184 |
| 5,272,511 | A | * | 12/1993 | Conrad et al. | 399/382 |
| 5,348,283 | A | | 9/1994 | Yanagi et al. | 271/127 |
| 5,592,280 | A | | 1/1997 | Ishizuka et al. | 399/410 |
| 5,648,808 | A | | 7/1997 | Yanagi et al. | 347/104 |
| 5,725,319 | A | | 3/1998 | Saito et al. | 400/629 |
| 5,810,346 | A | * | 9/1998 | Jorg | 270/59 |
| 5,911,414 | A | | 6/1999 | Kato et al. | 270/58.07 |
| 5,951,004 | A | * | 9/1999 | Hadfy-Kovacs et al. | 271/184 |
| 6,027,270 | A | * | 2/2000 | Greive | 400/625 |
| 6,145,826 | A | | 11/2000 | Kawata | 270/58.28 |
| 6,168,270 | B1 | | 1/2001 | Saikawa et al. | 347/104 |
| 6,199,850 | B1 | * | 3/2001 | Seki | 270/58.07 |
| 6,237,910 | B1 | | 5/2001 | Kawata | 271/213 |
| 6,241,234 | B1 | | 6/2001 | Saitoh et al. | 270/58.12 |
| 6,264,189 | B1 | | 7/2001 | Kawata | 271/176 |
| 6,505,829 | B2 | | 1/2003 | Kawata | 271/208 |
| 6,616,135 | B1 | * | 9/2003 | Shida et al. | 270/58.08 |
| 2003/0026633 | A1 | | 2/2003 | Nakagawa et al. | 399/367 |
| 2003/0049060 | A1 | | 3/2003 | Suzuki | 399/361 |
| 2003/0049063 | A1 | | 3/2003 | Suzuki et al. | 399/407 |

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

A sheet processing device has a sheet conveying section for conveying sheets to a sheet processing section. The sheet conveying section has a sheet standby unit including a stacking device for stacking a predetermined number of sheets in a linear state, and a bundle conveying device for conveying the sheet bundle stacked in a linear state, whereby the predetermined number of sheets are conveyed to the sheet processing section after having been stacked in a linear state.

32 Claims, 10 Drawing Sheets

(PRIOR ART)

SHEET PROCESSING WITH SHEET INSERTING DEVICE

BACKGROUND OF THE INVENTION

1. Field of the Invention

The present invention relates to a sheet processing device that performs processing such as the sorting and binding of sheets and, more particularly, to sheet conveying sections for conveying sheets to a sheet processing section. Still more particularly, the present invention relates to a sheet processing device capable of keeping large amounts of sheets on standby, irrespective of the size and material of the sheets and without the need to upsize the device itself.

2. Description of the Related Art

In recent years, some image forming apparatuses such as copy machines, printers, facsimiles, and the like, have a sheet processing device that selectively applies processing such as stapling or saddle stitch bookbinding to sheets having an image formed thereon.

In such processing devices, a buffer is provided upstream of the processing section, for keeping a plurality of sheets on standby, whereby processing can be performed without reducing productivity of the image forming apparatus.

FIG. 10 shows an image forming apparatus capable of high-speed, large-capacity image formation and having a conventional sheet processing device. Sheets S discharged from an image forming apparatus 100 are conveyed to a sheet processing device 102, and then aligned by a processing tray 103 provided in the sheet processing device 102. Thereafter, the sheets are stapled by a stapler 104, and discharged to a stack tray 105.

While the sheet bundle is being stapled in this manner, subsequent sheets cannot be delivered to the processing tray 103. In such a case, therefore, after a conveying path has been switched by a flapper 102*a*, the sheets are stacked one on top of another, with the front ends thereof aligned, and they are wound around a buffer roller 106. In this state, the sheets are kept on standby in buffer path Pa.

After the above-described sheets having been stapled are discharged to the stack tray 105, the sheets in buffer path Pa are conveyed to the processing tray section 103 in a stacked state. By repeating this operation, the stapling treatment can be performed without reduction in productivity of the image forming apparatus 100.

In FIG. 10, reference numeral 114 denotes an inserter for setting sheets that are not to be printed on, references 107*a* and 107*b* are accommodating sections provided in the inserter 114, and reference numeral 115 denotes a feed section for feeding sheets S accommodated in the accommodating sections 107*a* and 107*b*.

Here, the inserter 114 is for accommodating sheets S1 to be inserted in the accommodating sections 107*a* and 107*b*, and conveying them to the sheet processing device 102, while merging therewith the sheets S from the image forming section 100A. For example, the merging occurs when the present image forming apparatus 100 is dedicated to a black-and-white printer, and color print sheets are to be inserted into a bound book, or when sheets to be inserted are specific sheets (e.g., heat-sensitive sheets) that cannot be passed through the image forming section 100A of the present image forming apparatus 100.

In FIG. 10, reference numeral 108 denotes a saddle stitching section that performs processing from stapling to bundle folding on-line. The sheet processing device 102 connected to the above-described high-speed, large-capacity image forming apparatus 100 includes, besides the saddle stitching section 108, a "perfect binding" bookbinder that binds a book by pasting a spine to an aligned sheet bundle, and an offset stacker that performs only sorting and alignment on-line, with the bookbinding operation being conducted off-line. These may be connected to the system for use, depending on the purpose for using.

However, such a conventional sheet processing device has involved a problem in that the device itself increases in size because it has therein a buffer path Pa.

Specifically, under the size condition of the buffer roller 106 shown in FIG. 10, large-sized sheets such as A3 or B4 cannot be wound around the buffer roller 106. When attempting to keep large-sized sheets on standby, a larger buffer roller is required.

Also, when attempting to wind thick sheets around the buffer roller 106, high stiffness of the thick sheets increases the conveyance resistance, thereby causing skewing or jamming of the sheets. Furthermore, when the buffer path Pa is formed by the buffer roller 106, there is a limit to the number of sheets to be stacked, because sheets are stacked while being conveyed in the buffer path Pa with a curvature. This might reduce the productivity of the image forming apparatus when performing time-consuming processing such as "perfect binding" book-binding.

SUMMARY OF THE INVENTION

Accordingly, it is an object of the present invention to provide a sheet processing device capable of keeping large amounts of sheets on standby, irrespective of the size and material of the sheets and without the need to upsize the device itself.

In one aspect of the invention, there is provided a sheet processing device that includes a sheet conveying section that conveys a sheet from an image forming apparatus; a sheet processing section that processes sheets conveyed from the sheet conveying section; and a sheet inserting device disposed between the image forming apparatus and the sheet processing section and including sheet accommodating sections for accommodating sheets that are not to be passed through the image forming apparatus, and paper feed means for feeding the sheets accommodated in the sheet accommodating section to the sheet conveying section in a predetermined order. The paper conveying section has a sheet standby unit including stacking means that stacks a predetermined number of sheets one on top of another, in a linear state with the ends thereof aligned, and bundle conveying means that conveys the stacked sheet bundle.

In the sheet processing device according to the present invention, it is preferable that the stacking means include an abutting section for aligning the ends of the sheets; abutting means for abutting a sheet against the abutting section; and hold-down means for holding down the end of the sheet abutted against the abutting section, opposite to the abutting section. It is also preferable that, after having held down the end of the sheet by the hold-down means, the stacking means superimpose a next sheet over the above-described sheet.

Preferably, the sheet processing device according to the present invention further includes a moving stage that supports the abutting section and the abutting means, and a reciprocating unit for reciprocal moving of the moving stage along the sheet conveying direction.

In the sheet processing device according to the present invention, it is preferable that the reciprocating unit move the moving stage an amount in accordance with a length of the sheet in the sheet conveying direction.

Preferably, the sheet processing device according to the present invention further includes a moving stage that supports the hold-down means, and a reciprocating unit for reciprocal moving of the moving stage along the sheet conveying direction.

In the sheet processing device according to the present invention, it is preferable that the reciprocating unit move the moving stage between a position where the hold-down means is away from the sheet and a position where the hold-down means holds down the end of the sheet.

In the sheet processing device according to the present invention, the sheet conveying section may comprise a sheet conveying path through which a sheet conveyed to the sheet processing section passes, and that the sheet standby unit be disposed in the sheet conveying path.

In the sheet processing device according to the present invention, the hold-down means may be a flapper that is turnable upward and downward, and that holds down the end of the sheet by turning downward.

In the sheet processing device according to the present invention, the sheet conveying section may comprise a sheet conveying path through which a sheet conveyed to the sheet processing section passes, and that the sheet standby unit be provided in an intermediate tray disposed above or below the sheet conveying path.

The sheet processing device according to the present invention further includes detecting means provided upstream of the sheet conveying path in the sheet conveying direction for detecting multi-feed, skewing of sheets, and/or image anomalies thereon, and preferably, the sheet processing device selectively introduces the sheets into the intermediate tray based on the detection results by the detecting means.

In the sheet processing device according to the present invention, the sheet processing section may be disposed either above or below the sheet standby unit.

In the sheet processing device according to the present invention, preferably, the sheet standby unit is disposed downstream of the sheet inserting device in the sheet conveying direction.

In the sheet processing device according to the present invention, it is preferable that the sheet conveying section be positioned to convey a sheet from the image forming apparatus to the sheet processing section.

In the sheet processing device according to the present invention, the sheet conveying section may be constituted of a plurality of sheet conveying sections so as to form a linear sheet conveying path.

In the sheet processing device according to the present invention, the abutting means may be formed of at least one paddle.

Thus, by providing the sheet standby unit in the sheet conveying section for conveying sheets to the sheet processing section, stacking a predetermined number of sheets in an aligned state, and thereafter conveying them to the sheet processing section, it is possible to keep large amounts of sheets on standby, irrespective of the size and material of the sheets and without the need to upsize the device itself.

Further objects, features and advantages of the present invention will become apparent from the following description of the preferred embodiments with reference to the attached drawings.

DESCRIPTION OF THE PREFERRED EMBODIMENTS

Hereinafter, the embodiments according to the present invention will be described with reference to the accompanying drawings.

Figure 1:
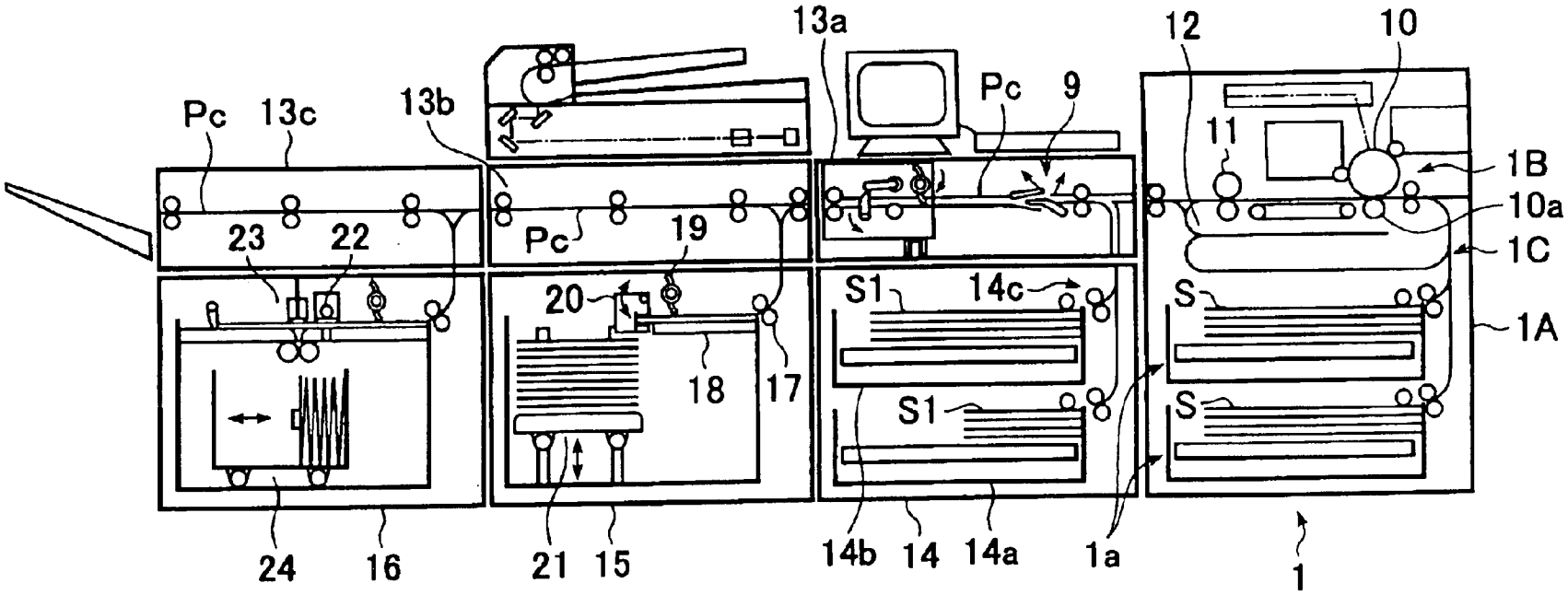
FIG. 1 is a schematic view showing the construction of an image forming apparatus having a sheet processing device according to a first embodiment of the present invention.

FIG. 1 is a schematic view showing the construction of an image forming apparatus having a sheet processing device according to a first embodiment of the present invention.

Referring to FIG. 1, reference numeral 1 denotes an image forming apparatus, reference numeral 1A denotes the main body of the image forming apparatus, and reference numeral 14 denotes an inserter, which is a sheet inserting device provided adjacent to and downstream of the image forming apparatus 1, and reference numerals 15 and 16, respectively, denote a staple stacker and saddle stitch stacker, each of which constitutes a sheet processing device provided downstream of the inserter 14.

Here, the image forming apparatus 1 includes an image forming section 1B comprising a photosensitive drum 10, fixing section 11 and so-on; and a sheet feeding section 1C that feeds sheets S accommodated in cassettes 1*a* to the image forming section 1B.

When forming an image, laser light is first applied on the photosensitive drum 10 to form an electrostatic latent image on the photosensitive drum 10, and thereafter, the electrostatic latent image is visualized. Also, sheets S are fed from the cassettes 1*a* or from a double-sided conveying path 12 at a timing in synchronization with the start of application of the laser light.

Next, the sheet S is conveyed between the photosensitive drum 10 and a transfer roller 10*a*, and when the sheet S passes therebetween, a developer image is transferred on the sheet by the transfer roller 10*a*. Then, the sheet on which the developer image has been transferred is conveyed to the fixing section 11, and the developer image is fixed on the sheet by applying heat and pressure at the fixing section 11.

Thereafter, the sheet S on which the developer image has been fixed is discharged toward the inserter 14 through a flapper (not shown) and a discharge roller. When forming images on both sides of the sheet S, the sheet S is introduced into the double-sided conveying path 12 by a switching operation of the flapper, and thereafter the sheet S is again conveyed between the photosensitive drum 10 and the transfer roller 10*a* at the aforementioned timing.

In FIG. 1, reference numerals 13*a*, 13*b*, and 13*c* denote plural (three, in this embodiment) sheet conveying sections provided downstream of the image forming apparatus 1. The sheet conveying sections 13*a*, 13*b*, and 13*c* forms a linear-shaped sheet conveying path Pc extending in substantially horizontal direction for conveying sheets S.

The portion below the sheet conveying section 13*a*, which is the nearest to the image forming apparatus 1, includes an inserter 14 comprising two sheet accommodating sections 14*a* and 14*b* where inserted sheets S1 that are not to be printed, that is, ones that are not to be passed through the image forming apparatus 1, are set, and a sheet feed section 14*c*, which may serve as paper feed means for conveying sheets accommodated in the sheet accommodating sections 14*a* and 14*b* in a predetermined order. Here, the group of sheet accommodating sections 14*a* and 14*b* and the sheet feed section 14*c* in the inserter 14 have the same construction as that of the group of the cassettes 1*a* and the sheet feed section 1C in the image forming apparatus 1. The former and the latter groups maintain compatibility with each other.

The portion below the sheet conveying sections 13*b* and 13*c*, which is located downstream of the sheet conveying section 13*a*, includes a staple stacker 15 comprising a stapler 20, container 21, paddle device 19 and the like, which constitute the sheet processing section, for performing alignment and sorting of a sheet bundle and loading them; and a saddle stitch stacker 16 comprising a stapler 22 for stapling sheets at two portions at the center thereof, and a folding device 23 for folding the sheets at the central portion thereof and discharging the sheets to a folding stacker 24, the stapler 22 and folding device 23 constituting the sheet processing section.

With these features, the inserted sheets S1 accommodated in the sheet accommodating sections 14*a* and 14*b* of the inserter 14 are inserted between sheets S passed through the image forming apparatus 1 via the sheet conveying path Pc in a predetermined order, and these sheets including S1 and S are conveyed to the staple stacker 15 or the saddle stitch stacker 16 according to a set mode, such as the stapling mode or the bookbinding mode.

The sheets S and S1 conveyed to the staple stacker 15 are conveyed to a feed roller 17 and onto a processing tray 18. Then, they are abutted against the stapler 20 by the paddle device 19 for alignment. Thereafter, the staple stacker 15 staples the sheets S and S1 thus aligned by the stapler 20. After the completion of this stapling treatment, the stapler 20 is moved, and the sheets S and S1 are discharged onto the container 21. As the loading goes on, the container 21 gradually descends. After the container is chock-full loaded with the sheets, it is pulled out toward the front, whereby the sheets can be conveyed in a next process.

On the other hand, the sheets conveyed to the saddle stitch stacker 16 are firstly stapled at two portions at the center thereof by the stapler 22, and then, after having been folded by the folding device 23 at the center portion thereof, the sheets are discharged onto the stacker 24.

In FIG. 1, reference 9 denotes a sheet standby section, which may serve as a sheet standby unit provided in the sheet conveying section 13*a*. The sheet standby section 9 is configured to be able to keep a predetermined number of sheets S and S1 conveyed from the image forming apparatus 1 and the inserter 14, on standby in a stacked state, while the staple stacker 15 or saddle stitch stacker 16 (hereinafter, these are collectively referred to as the "staple stacker 15 or the like") is performing processing.

Figure 2A:
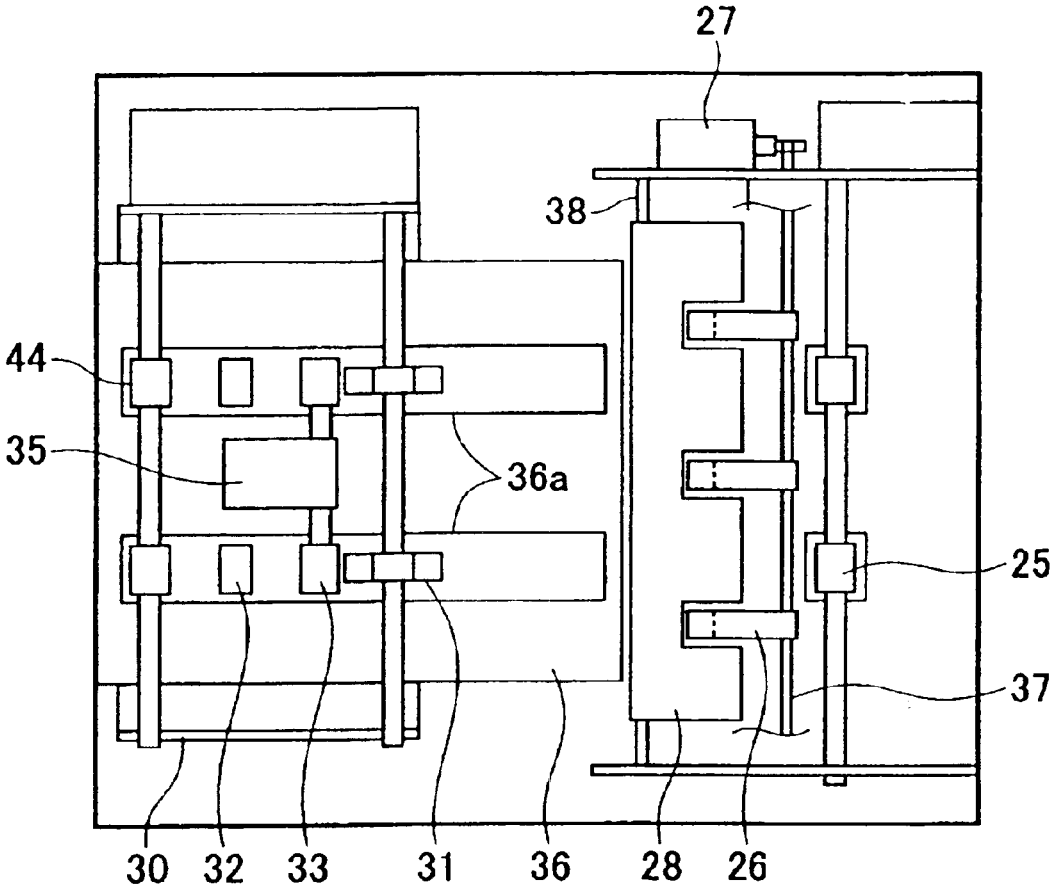
FIGS. 2A and 2B are a plan view and schematic diagram, respectively, of a sheet standby section provided in the sheet processing device shown in FIG. 1.
Figure 2B:
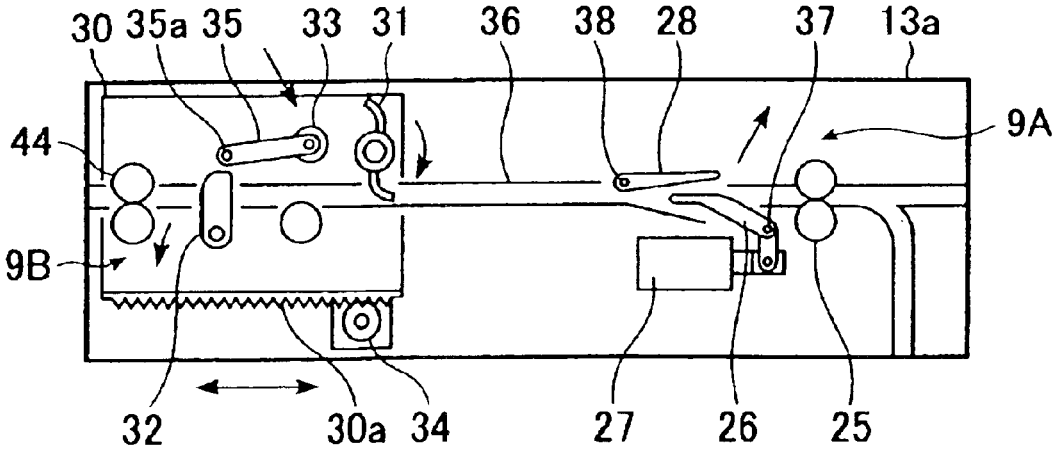

As shown in FIG. 2A and 2B, the sheet standby section 9 includes a swinging guide 28 that is supported so as to be turnable about a support shaft 38; a rear-end flapper 26, which is hold-down means turned upward about a support shaft 37 by a solenoid 27; a delivery roller 25; shutters 32, which form an abutting section turnably provided, a paddle 31, which is abutting means for abutting the sheets S and S1 delivered by the delivery roller 25 against the shutters 32, and stacking means 9A that stacks sheets S one on top of another, in a linear state and in a manner such as to keep the ends thereof aligned.

As shown in FIG. 2A, the turning end of the swinging guides 28 is cut in into a comb shape, so that, when the rear-end flapper 26 turns, it is not hindered from turning by the swinging guide 28.

The sheet standby section 9 is retained by an arm 35, and includes a bundle conveying rollers 33 that turns about a fulcrum 35*a* in interlock with the shutters 32, a discharge rollers 44 for discharging sheets, and bundle conveying means 9B for conveying a stacked sheet bundle.

Next, stacking operation in the sheet standby section 9 with these features will be described.

Figure 3A:
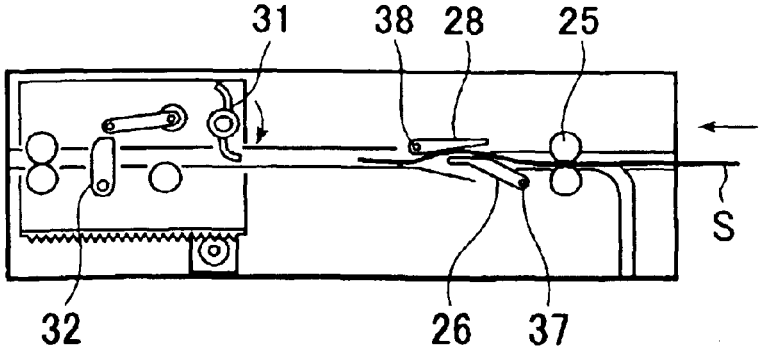
FIGS. 3A to 3E are schematic diagrams illustrating a sheet stacking operation of the sheet standby section shown in FIGS. 2A and 2B.

First, for example, a sheet S delivered from the image forming apparatus 1 (image forming section 1B) is conveyed by the delivery roller 25 and passes through the rear-end flapper 26, as shown in FIG. 3A. Thereafter, the sheet S is conveyed until the front end thereof is abutted against the shutters 32 by the paddle 31, as shown in FIG. 3B.

Figure 3B:
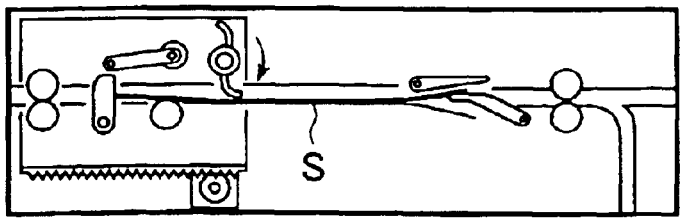
Figure 3C:
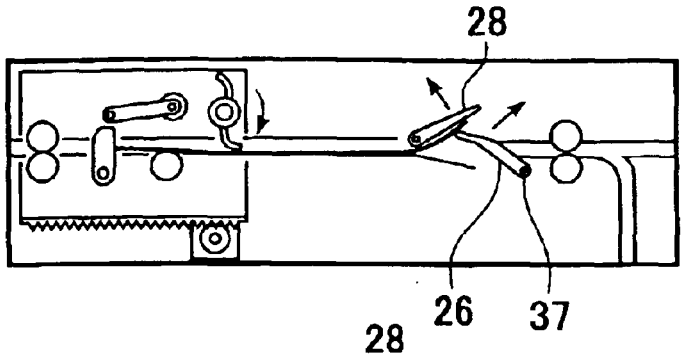

When a detection sensor (not shown) detects that the front end of the sheet S has been abutted against the shutters 32, a control section (not shown) turns on the solenoid 27, whereby the rear-end flapper 26 turns upward about the support shaft 37 and lifts the rear end of the sheet, as shown in FIG. 3C.

Usually, the swinging guide 28 is locked by a stopper (not shown) under the self weight thereof, and is on standby at a position shown in FIG. 3B. However, when the rear-end flapper 26 turns upward and consequently the sheet rear end is lifted, the rear-end flapper 26 is also lifted together with the sheet rear end, as shown in FIG. 3C.

Figure 3D:
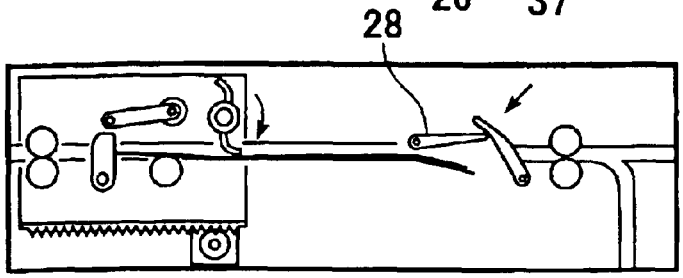

Thereafter, when the rear-end flapper 26 continues turning, and the front end thereof disengages from the sheet rear end, the sheet rear end is without support and descends, so that the swinging guide 28 also descends. As a result, the sheet S is regulated downward by the swinging guided 28, as shown in FIG. 3D.

Figure 3E:
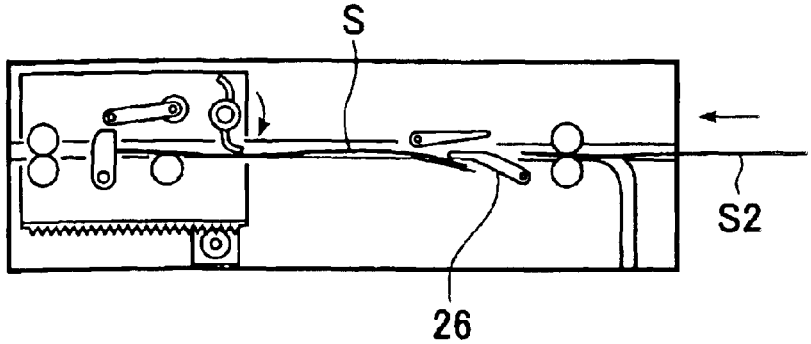

When the solenoid is turned off after the sheet S has been regulated downward by the swinging guide 28, the rear-end flapper 26 turns downward, and as shown in FIG. 3E, it returns to its original position while holding down the sheet rear end from above.

Now, when a next sheet S2 is conveyed after the rear-end flapper 26 has thus returned to the original position, the newly conveyed sheet S2 passes over the top surface of the rear-end flapper 26, and is delivered onto the previously conveyed sheet S. The sheet S2 is superimposed over the sheet S with the front ends thereof kept aligned and in a linear state.

This operation is repeated until processing of a preceding sheet bundle by the staple stacker 15 and the like disposed downstream of the inserter 14 in the conveying direction is completed, and a delivery of a subsequent sheet bundle to the staple stacker 15 and the like becomes possible. As a result, the sheet S can be kept on standby without stopping image forming operation. This prevents a reduction in productivity of the image forming apparatus 1.

In this manner, by providing the sheet standby section 9 on the downstream side of the inserter 14, it is possible to accommodate a front cover and slip sheets used when performing bookbinding treatment, in the sheet accommodating sections 14*a* and 14*b* of the inserter 14, and also to keep these cover and slip sheets on standby. This increases efficiency in bookbinding treatment.

Now, a bundle conveying operation after the sheet bundle has thus been kept on standby, will be described with reference to FIGS. 4A, 4B and 4C.

Figure 4A:
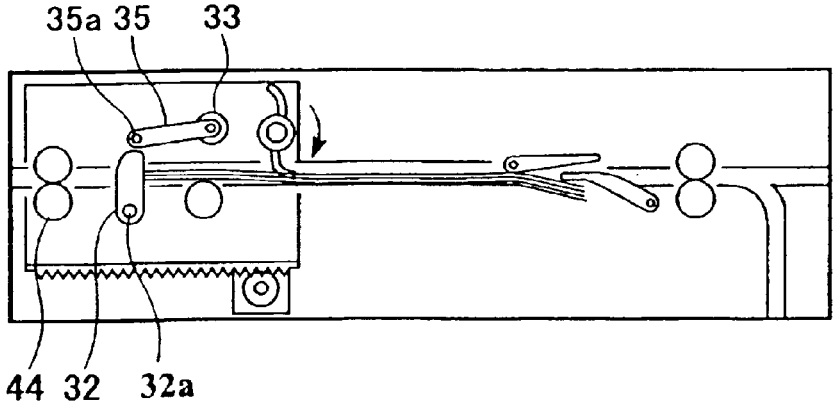
FIGS. 4A to 4C are schematic diagrams illustrating a bundle conveying operation of the sheet standby section.
Figure 4B:
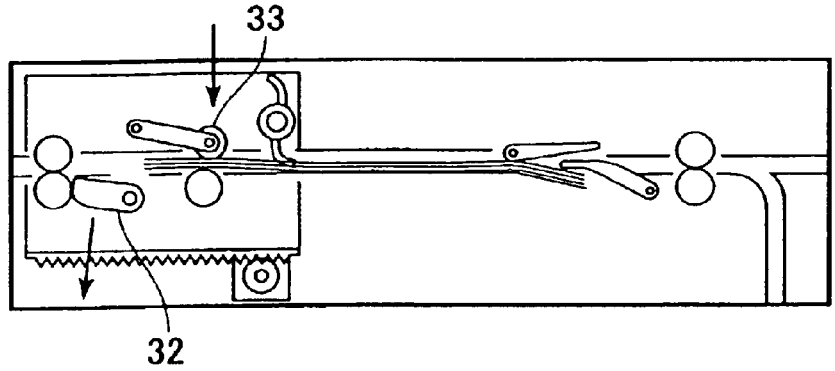
Figure 4C:
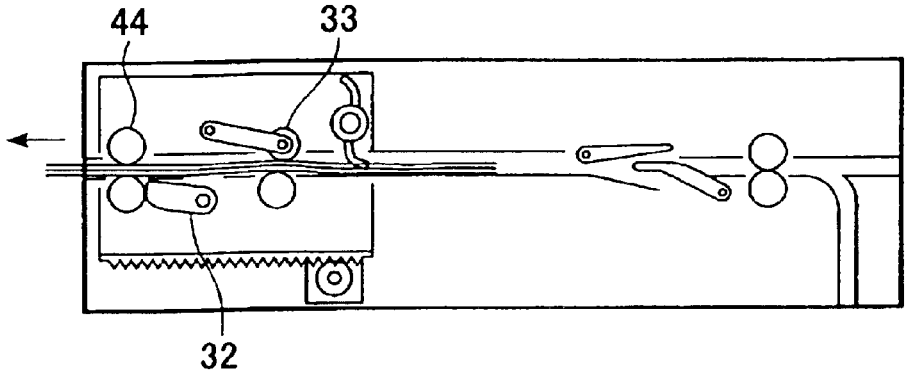

When the processing of the preceding sheet bundle by the staple stacker 15 and the like has been completed, the delivery of the subsequent sheet bundle to the staple stacker 15 and the like becomes possible, and as shown in FIG. 4A, the stacking of the sheets S has been completed, the shutters 32 turn about the support shaft 32*a*, and retreats downward as shown in FIG. 4B.

At this time, the bundle conveying rollers 33 retained by the arm 35 turns about the fulcrum 35*a* in interlock with shutters 32, and is brought into pressure contact with the sheets S. Thereafter, the stacked sheet bundle is delivered to the staple stacker 15 and the like by the bundle conveying rollers 33 and discharge rollers 44, as shown in FIG. 4C.

In the present embodiment, the paddle 31, shutters 32, bundle conveying rollers 33, and discharge rollers 44 are fixed to (held by) a moving stage 30 shown in FIG. 2B. By a motor 34 and rack 30*a*, the moving stage 30 is allowed to reciprocate according to the sheet size, along a guide plate 36 in the right and left direction, which is the sheet conveying direction. This makes it possible for the shutters 32 to move to the sheet front-end abutting position according to the sheet size. Here, the guide plate 36 has therein a slit 36*a* in order to prevent movements of the paddle 31, rollers 33 and 44, and shutters 32 from being hindered by the guide plate 36.

Figure 5A:
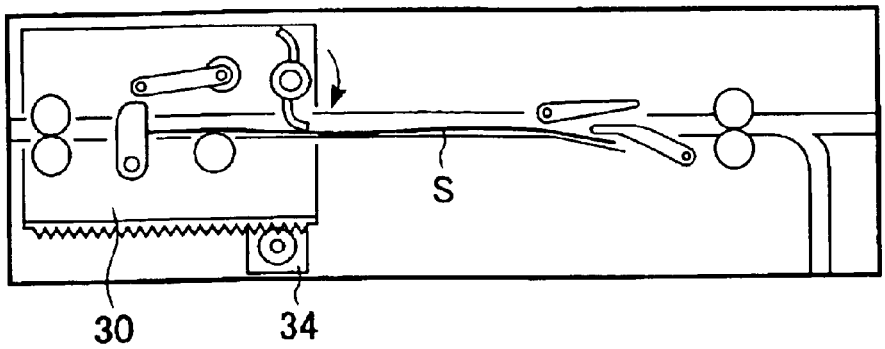
FIGS. 5A and 5B are schematic diagrams illustrating movements of a moving stage in the sheet standby section, in which the movement thereof changes depending on the sheet size.
Figure 5B:
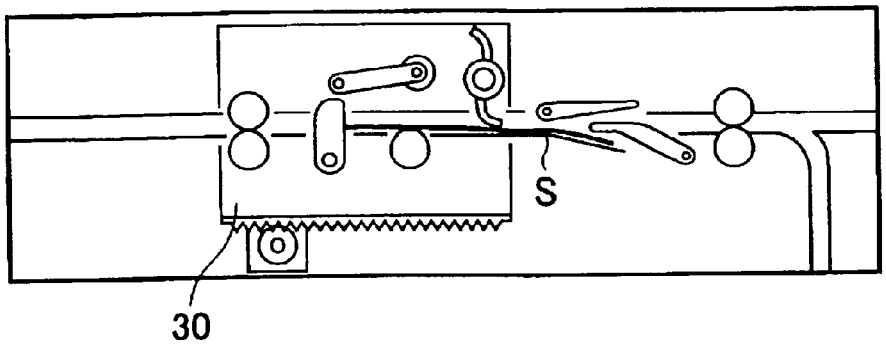

FIGS. 5A and 5B illustrates movements of the moving stage 30. FIG. 5A shows a state in which the moving stage 30 has been moved to the left to accommodate large-sized sheets that have been stacked. On the other hand, FIG. 5B shows a state in which the moving stage 30 has been moved to the right by the motor 34 and small-sized sheets have been stacked.

In this manner, by providing the sheet standby section 9 in the sheet conveying section 13*a*, stacking a predetermined number of sheets in a linear state, and then conveying them to the staple stacker 15 or the like, an increase in conveyance resistance can be inhibited even when the sheets has high stiffness. This prevents the occurrence of skewing or jamming of the sheets.

Also, since the number of sheets to be stacked can be increased, there is no risk of a reduction in productivity of the image forming apparatus 1 even when performing time-consuming processing, such as "perfect binding" bookbinding, in which binding is conducted using an adhesive without employing strings or wires. Furthermore, providing the sheet standby section 9 in an ordinary sheet conveying path, as in the present embodiment, enables the downsizing of the device.

Next, a second embodiment according to the present invention will be described.

FIGS. 6A to 6E are diagrams explaining the arrangement of a sheet standby section according to the second embodiment. In FIGS. 6A to 6E, the same reference numerals denote the same or equivalent parts as those in FIGS. 2A and 2B.

Referring to FIGS. 6A to 6E, reference numeral 39 denotes a moving stage moveable in the right and left direction. The moving stage 39 has the rear-end flapper 26 and solenoid 27. In this embodiment, the sheet rear end is held down by reciprocating, by the motor 40, the rear-end flapper 26 together with the moving stage 39 in the right and left direction.

Now, sheet stacking operation in this embodiment will be described.

Figure 6A:
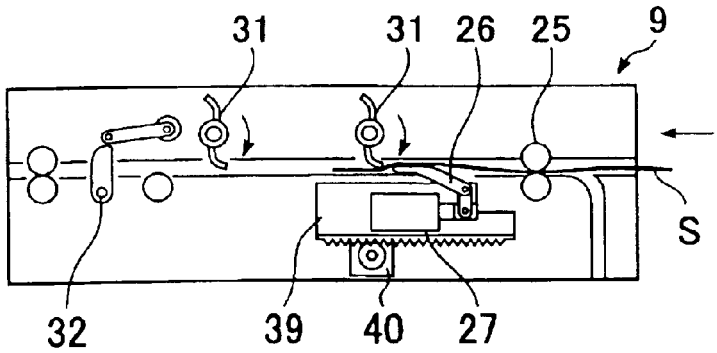
FIGS. 6A to 6E are schematic diagrams illustrating a sheet stacking operation in the sheet standby section of a sheet processing device according to a second embodiment of the present invention.
Figure 6B:
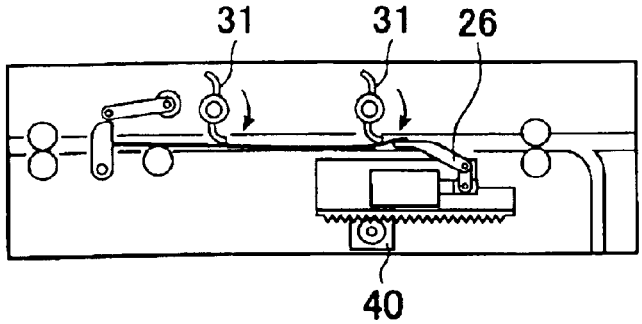
Figure 6C:
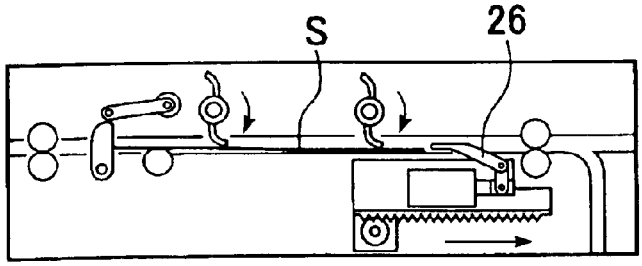
Figure 6D:
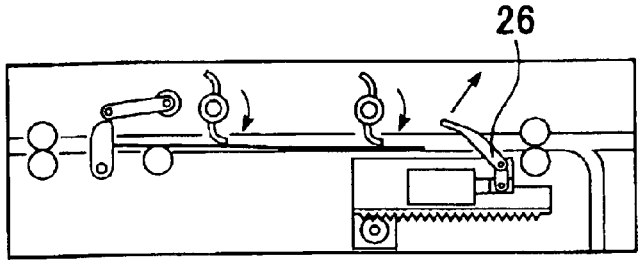

First, a sheet S delivered from the image forming apparatus 1B is conveyed by the delivery roller 25 and passes over the rear-end flapper 26, as shown in FIG. 6A. Next, the sheet S is abutted against the shutters 32 by two paddle devices 31, as shown in FIG. 6B. Then, the moving stage 39 is moved to the right by the motor 40 as shown in FIG. 6C, and thereafter, when the sheet rear end passes the rear-end flapper 26, the flapper 26 is turned upward by the solenoid 27, as shown in FIG. 6D.

Figure 6E:
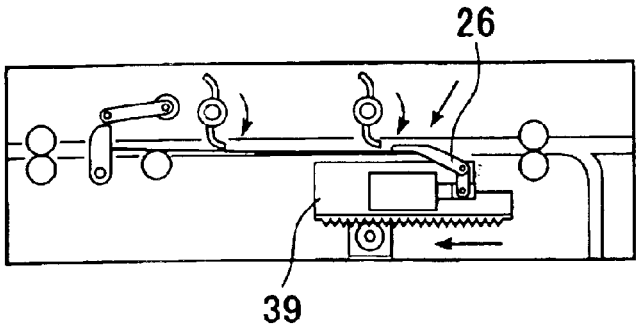

With the rear-end flapper 26 turned upward, the moving stage 39 is moved to the left, and then, as shown in FIG. 6E, the sheet rear end is held down from the top surface thereof by lowering the rear-end flapper 26. In this state, the moving stage waits for the delivery of the next sheet.

After a predetermined number of sheets are stacked by repeating the above-described operation, the shutters 32 is opened by the same procedure as that of the above-described first embodiment, and the sheet bundle is conveyed to the staple stacker 15 and the like.

Figure 7A:
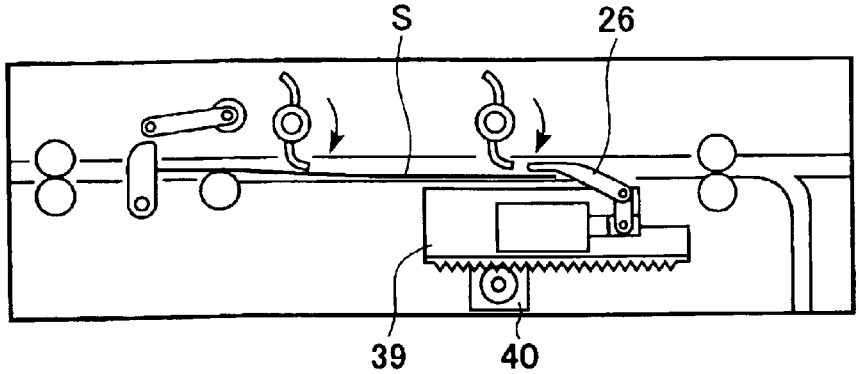
FIGS. 7A and 7B are schematic diagrams illustrating movements of the moving stage in the sheet standby section, in which the movement thereof changes depending on the sheet size.
Figure 7B:
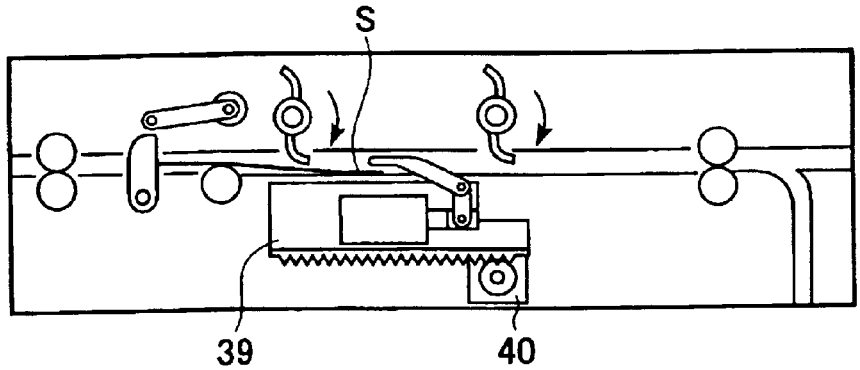

FIGS. 7A and 7B illustrate movements of the moving stage 39 according to the sheet size. FIG. 7A shows a position of the moving stage 39 when large-sized sheets are loaded, while FIG. 7B shows a position thereof when small-sized sheets are loaded.

Next, a third embodiment according to the present invention will be described.

Figure 8:
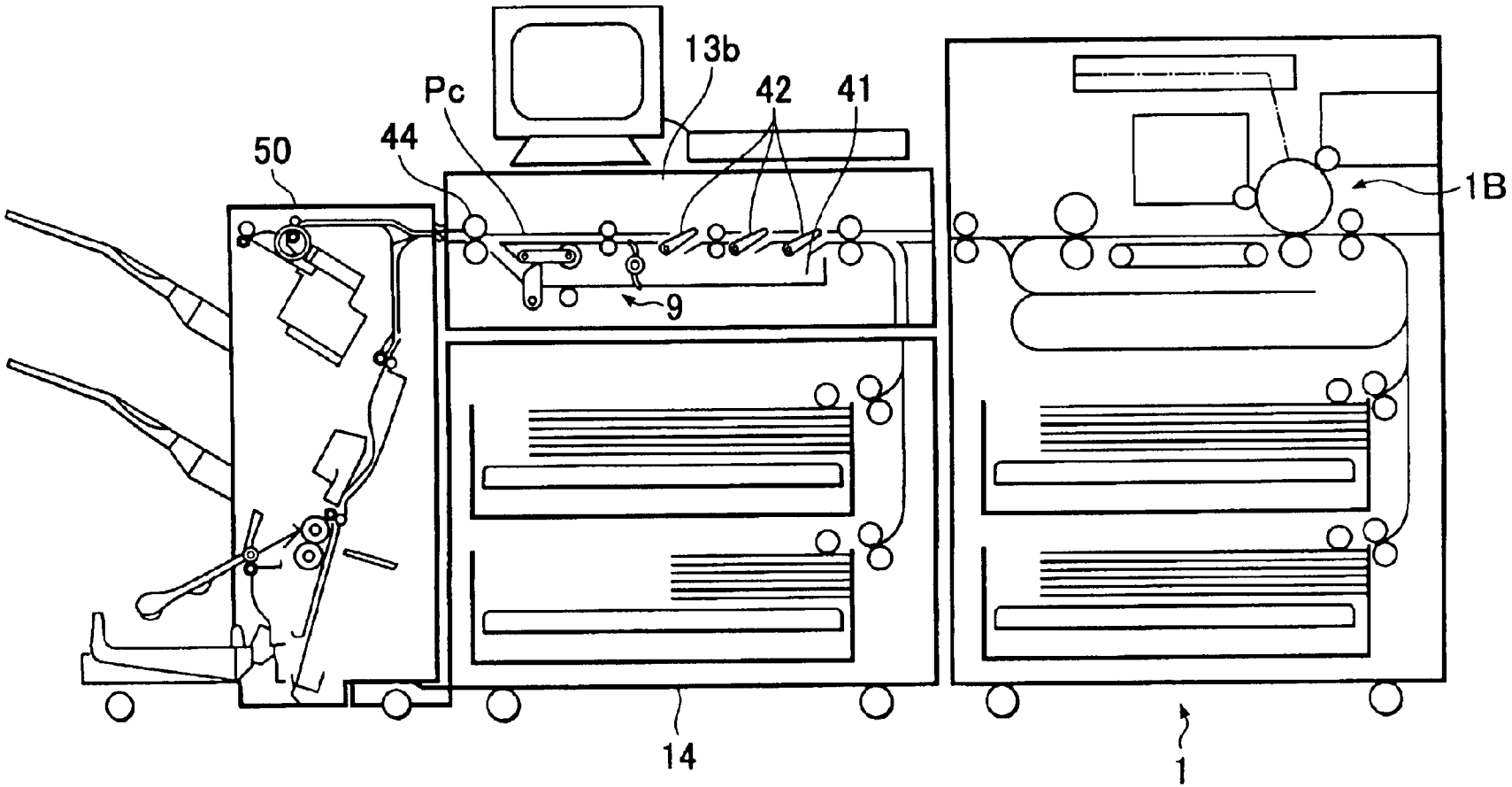
FIG. 8 is a schematic view showing the construction of an image forming apparatus having a sheet processing device according to a third embodiment of the present invention.

FIG. 8 is a schematic view showing the construction of an image forming apparatus having a sheet processing device according to the third embodiment. In FIG. 8, the same reference numerals denote the same or equivalent parts as those in FIGS. 1.

Referring to FIG. 8, reference numeral 41 designates an intermediate tray disposed below the sheet conveying path PC. In this embodiment, the intermediate tray 41 has the sheet standby section 9, and is arranged to stack sheets and be on standby. In FIG. 8, reference numeral 42 designates a plurality of path switching flappers provided in the sheet conveying path Pc. A sheet passing through the sheet conveying path Pc is delivered into the intermediate tray 41 by turning downward a predetermined path switching flapper 42 according to the size of sheet.

A plurality of sheets is stacked one on top of another by the switching of the path switching flapper 42, in a linear state and so as to align the ends thereof, and thereafter, as in the case of the above-described first embodiment, the sheets are discharged to a sheet processing device 50 by the bundle conveying rollers 33 and discharge rollers 44.

Furthermore, providing another intermediate tray 41 for sheet standby, disposed in parallel with the substantially horizontal sheet conveying path Pc, enables more sheets, or various sheets such as cardboards or the like to be kept on standby.

In this embodiment, the intermediate tray 41 has been disposed below the sheet conveying path Pc, but it may also be disposed above the sheet conveying path Pc.

If it is arranged that sheets are conveyed to the intermediate tray 41 when multi-feed, skewing of sheets, and/or image anomalies thereon are detected by a sensor (not shown) that is provided upstream of the sheet conveying section 13*b* in the conveying direction for detecting multi-feed, skewing of sheets and/or image anomalies thereon, it becomes possible to use the intermediate tray 41 as an anomalous sheet standby tray.

Next, a fourth embodiment according to the present invention will be described.

Figure 9:
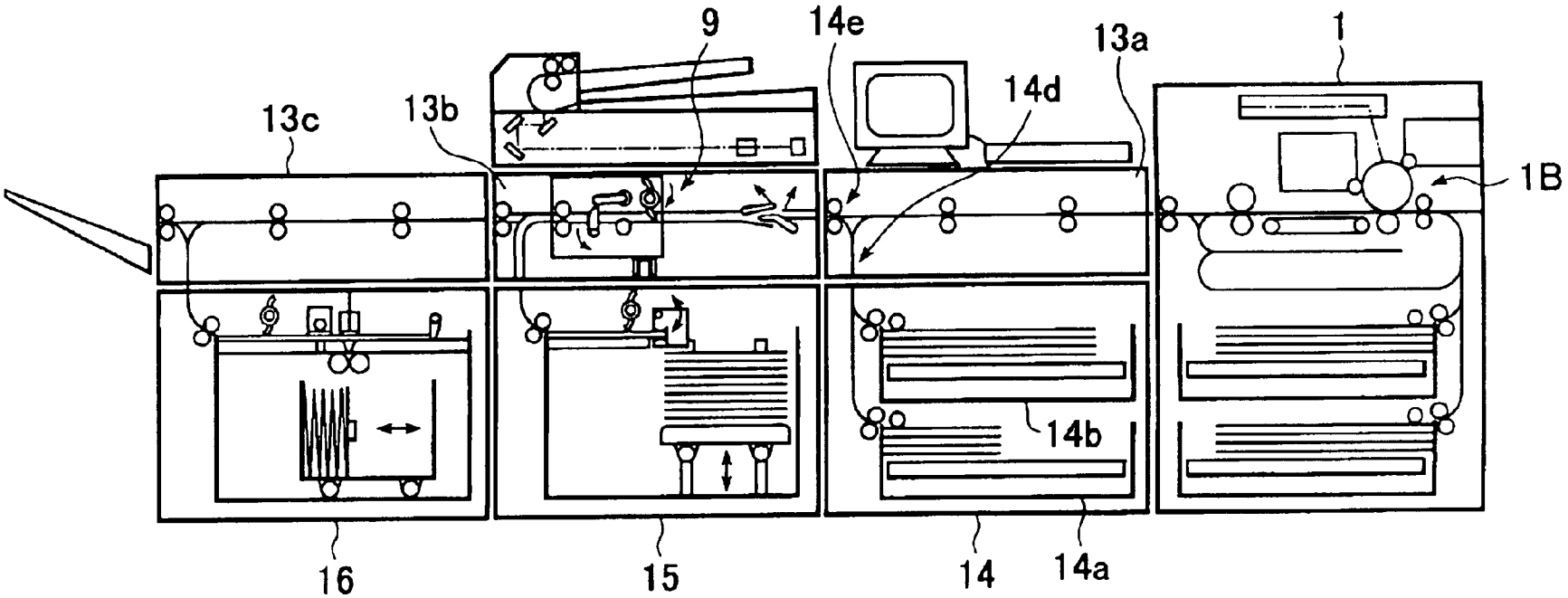
FIG. 9 is a schematic view showing the construction of an image forming apparatus having a sheet processing device according to a fourth embodiment of the present invention.
Figure 10:
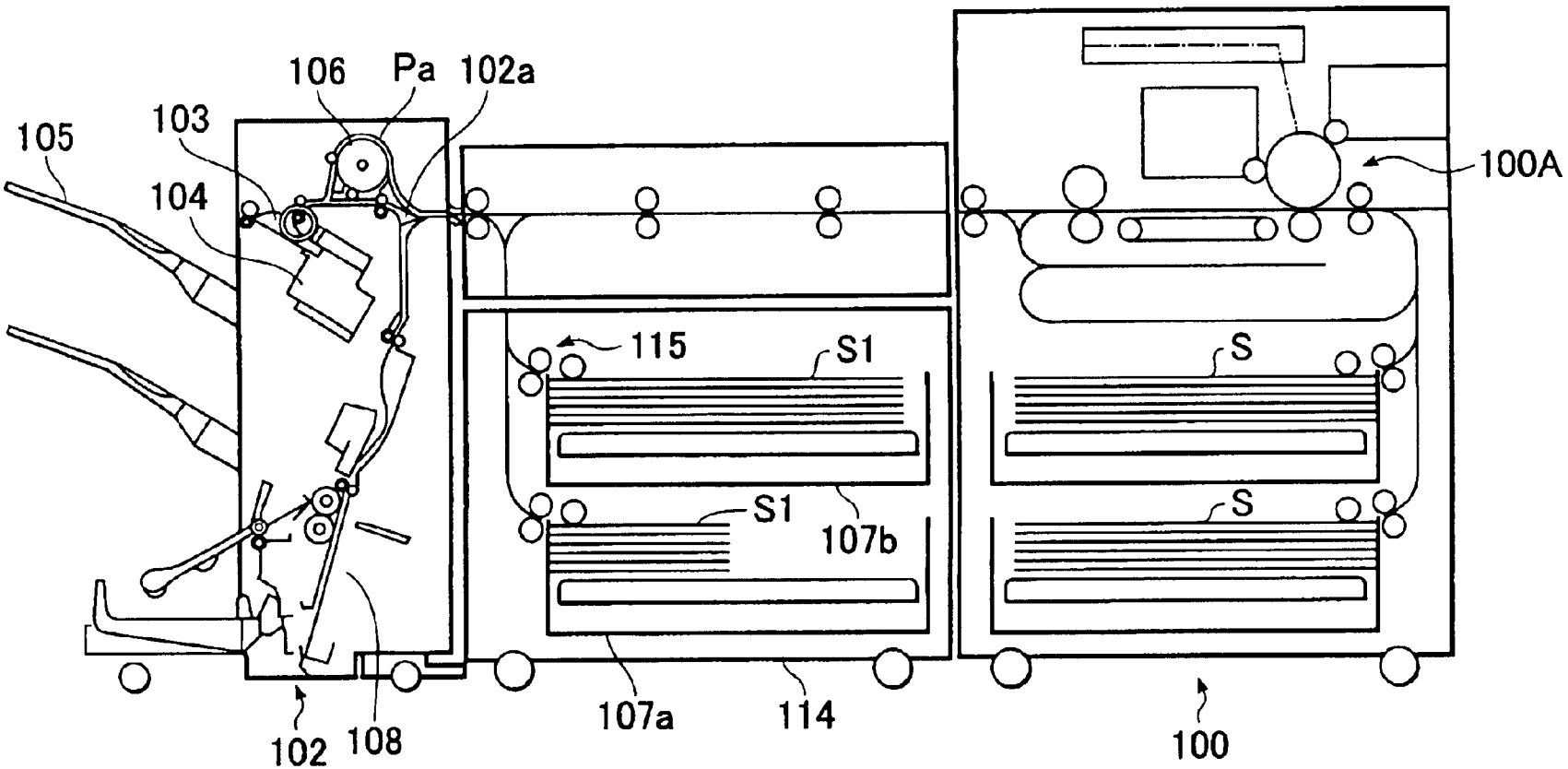
FIG. 10 is a schematic view showing the construction of a conventional image forming apparatus with a sheet processing device.

FIG. 9 is a schematic view showing the construction of an image forming apparatus having a sheet processing device according to the fourth embodiment. In FIG. 9, the same reference numerals denote the same or equivalent parts as those in FIGS. 1.

In this embodiment, a paper feed port 14*d* of the inserter 14 is located on the left side of the inserter 14, and a delivery port 14*e* to the staple stacker 15 is also located on the left side thereof. With these arrangements, when image forming is started from the top page, sheets each having an image formed on the top surface thereof in the image forming section 1B are automatically loaded in a state collated by page with the image surfaces thereof placed face down in the staple stacker 15. It is therefore unnecessary to reverse the sheet surfaces for each of the sheets.

Even when a printed sheet is set in the inserter 14, the top surface side thereof can be set as a printed surface. This improves the operationality in sheet setting. In this embodiment, in order that a sheet from the inserter 14 can also be kept on standby as required, the sheet standby section 9 is disposed above the staple stacker 15 located upstream of the saddle stitch stacker 16.

In this way, by providing the sheet standby section 9 on the downstream side of the inserter 14, it is possible to accommodate a front cover and slip sheets used when performing bookbinding treatment, in the sheet accommodating sections 14*a* and 14*b* of the inserter 14, and also to keep these cover and slip sheets on standby. This provides increased efficiency in bookbinding treatment.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A sheet processing device, comprising:

a sheet conveying section that conveys a sheet from an image forming apparatus;

a sheet processing section that processes sheets conveyed by said sheet conveying section; and a sheet inserting device disposed between the image forming apparatus and said sheet processing section, and including a sheet accommodating section that accommodates sheets not to be passed through said image forming apparatus, and a paper feed section that feeds the sheets accommodated in said sheet accommodating section to said sheet conveying section in a predetermined order, wherein said sheet conveying section has a sheet standby unit that keeps a predetermined number of sheets from at least one of said image forming apparatus and said sheet inserting device on standby while processing of a preceding sheet bundle at said sheet processing section, and wherein said sheet standby unit comprises stacking means for stacking and keeping the predetermined number of sheets one on top of another in a linear state on standby, and bundle conveying means for conveying said stacked sheet bundle to said sheet processing section after processing of said recording sheet bundle is completed.

2. The sheet processing device according to claim 1, wherein said stacking means comprises an abutting section that aligns the ends of said sheets; abutting means that urges a sheet to abut against said abutting section; and hold-down means that holds down an end of said sheet opposite to said abutting section, and wherein, after having held down the end of said sheet by said hold-down means, a next sheet is superimposed over said sheet with ends thereof.

3. The sheet processing device according to claim 2, further comprising a moving stage that supports said abutting section and said abutting means, and driving means that reciprocally moves said moving stage along the sheet conveying direction.

4. The sheet processing device according to claim 3, wherein said driving means moves said moving stage an amount in accordance with a length of said sheet in the sheet conveying direction.

5. The sheet processing device according to claim 2, further comprising a moving stage that supports said hold-down means and driving means for reciprocal moving of said moving stage along the sheet conveying direction.

6. The sheet processing device according to claim 5, wherein said driving means moves said moving stage between a position where said hold-down means is away from said sheet and a position where said hold-down means holds down the end of said sheet.

7. The sheet processing device according to claim 5, wherein said driving means moves said moving stage an amount in accordance with a length of said sheet in the sheet conveying direction.

8. The sheet processing device according to claim 2, wherein said hold-down means comprises a flapper that is turnable upward and downward and that holds down the end of said sheet when turned downward.

9. The sheet processing device according to claim 2, wherein said abutting means comprises a paddle.

10. The sheet processing device according to claim 1, wherein said sheet conveying section further comprises a sheet conveying path through which a sheet conveyed to said sheet processing section passes, and wherein said sheet standby unit is disposed in said sheet conveying path.

11. The sheet processing device according to claim 1, wherein said sheet conveying section further comprises a sheet conveying path through which a sheet conveyed to said sheet processing section passes, and wherein said sheet standby unit is provided in an intermediate tray disposed outside of said sheet conveying path.

12. The sheet processing device according to claim 11, further comprising detecting means provided on the upstream side of the sheet conveying path in the sheet conveying direction that detects at least one of multi-feed, skewing of sheets, and image anomalies on sheets, wherein said sheet processing device selectively introduces the sheets into said intermediate tray based on the detection results of said detecting means.

13. The sheet processing device according to claim 1, wherein said sheet processing section is disposed above or below said sheet standby unit.

14. The sheet processing device according to claim 1, wherein said sheet standby unit is disposed downstream of said sheet inserting device in the sheet conveying direction.

15. An image forming apparatus, comprising:

a recording device that forms an image on a sheet; and a sheet processing device provided on the downstream side of said recording device in the sheet conveying direction, said sheet processing device comprising:

a sheet conveying section that conveys a sheet from an image forming apparatus;

a sheet processing section that processes sheets conveyed by said sheet conveying section; and a sheet inserting device disposed between the image forming apparatus and said sheet processing section, and including a sheet accommodating section that accommodates sheets not to be passed through said image forming apparatus, and a paper feed section that feeds the sheets accommodated in said sheet accommodating section to said sheet conveying section in a predetermined order, wherein said sheet conveying section has a sheet standby unit that keeps a predetermined number of sheets from at least one of said image forming apparatus and said sheet inserting device on standby while processing of a preceding sheet bundle at said sheet processing section, and wherein said sheet standby unit comprises stacking means that stack and keep the predetermined number of sheets one on top of another in a linear state on standby, and bundle conveying means that conveys said stacked sheet bundle to said sheet processing section after processing of said preceding sheet bundle is completed.

16. The image forming apparatus according to claim 15, wherein said stacking means comprises an abutting section that aligns the ends of said sheets; abutting means that urges a sheet to abut against said abutting section; and hold-down means that hold down an end of said sheet opposite to said abutting section, and wherein, after having held down the end of said sheet by said hold-down means, a next sheet is superimposed over said sheet with ends thereof.

17. The image forming apparatus according to claim 16, further comprising a moving stage that supports said abutting section and said abutting means, and driving means that reciprocally moves said moving stage along the sheet conveying direction.

18. The image forming apparatus according to claim 17, wherein said driving means moves said moving stage an amount in accordance with a length of said sheet in the sheet conveying direction.

19. The image forming apparatus according to claim 16, further comprising a moving stage that supports said hold-down means and driving means that reciprocally moves said moving stage along the sheet conveying direction.

20. The image forming apparatus according to claim 19, wherein said driving means moves said moving stage between a position where said hold-down means is away from said sheet and a position where said hold-down means holds down the end of said sheet.

21. The image forming apparatus according to claim 19, wherein said driving means moves said moving stage an amount in accordance with a length of said sheet in the sheet conveying direction.

22. The image forming apparatus according to claim 16, wherein said hold-down means comprises a flapper that is turnable upward and downward and that holds down the ends of said sheet when turned downward.

23. The image forming apparatus according to claim 16, wherein said abutting means comprises a paddle.

24. The image forming apparatus according to claim 15, wherein said sheet conveying section further comprises a sheet conveying path through which a sheet conveyed to said sheet processing section passes, and wherein said sheet standby unit is disposed in said sheet conveying path.

25. The image forming apparatus according to claim 15, wherein said sheet conveying section further comprises a sheet conveying path through which a sheet conveyed to said sheet processing section passes, and wherein said sheet standby unit is provided in an intermediate tray disposed outside of said sheet conveying path.

26. The image forming apparatus according to claim 25, further comprising detecting means provided on the upstream side of the sheet conveying path in the sheet conveying direction for detecting at least one of multi-feed, skewing of sheets, and image anomalies on sheets, wherein said sheet processing device selectively introduces the sheets into said intermediate tray based on the detection results of said detecting means.

27. The image forming apparatus according to claim 15, wherein said sheet processing section is disposed above or below said sheet standby unit.

28. The image forming apparatus according to claim 15, wherein said sheet standby unit is disposed downstream of said sheet inserting device in the sheet conveying direction.

29. A sheet processing device, comprising:

a sheet conveying section that conveys a sheet from an image forming apparatus;

a sheet processing section that processes sheets conveyed by said sheet conveying section; and an inserter disposed between the image forming apparatus and said sheet processing section, and that feeds a sheet not to be passed through said image forming apparatus to said sheet conveying section in a predetermined order, wherein said sheet conveying section has a sheet standby unit that keeps a predetermined number of sheets from at least one of said image forming apparatus and said inserter on standby while processing of a preceding sheet bundle at said sheet processing section, and wherein the predetermined number of sheets are stacked and kept by said sheet standby unit one on top of another in a linear state on standby, and said stacked sheet bundle is conveyed to said sheet processing section by a bundle conveying rotary member after processing of said preceding sheet bundle is completed.

30. The sheet processing device according to claim 29, wherein said sheet standby unit comprises a shutter that aligns the ends of said sheets; a paddle that urges a sheet to abut against said shutter; and a flapper that holds down an end of said sheet opposite to said shutter, and wherein, after having held down the end of said sheet by said flapper, a next sheet is superimposed over said sheet with ends thereof.

31. An image forming apparatus, comprising:

a recording device that forms an image on a sheet; and a sheet processing device provided on the downstream side of said recording device in the sheet conveying direction, said sheet processing device comprising:

a sheet conveying section that conveys a sheet from an image forming apparatus;

a sheet processing section that processes sheets conveyed by said sheet conveying section; and an inserter disposed between the image forming apparatus and said sheet processing section, and that feeds a sheet not to be passed through said image forming apparatus to said sheet conveying section in a predetermined order, wherein said sheet conveying section has a sheet standby unit that keeps a predetermined number of sheets from at least one of said image forming apparatus and said inserter on standby during processing of a preceding sheet bundle at said sheet processing section, and wherein the predetermined number of sheets are stacked and kept by said sheet standby unit one on top of another in a linear state on standby, and said stacked sheet bundle is conveyed to said sheet processing section by bundle conveying rotary member after processing of said preceding sheet bundle is completed.

32. The image forming apparatus according to claim 31, wherein said sheet standby unit comprises a shutter that aligns the ends of said sheets; a paddle that urges a sheet to abut against said shutter; and a flapper that holds down an end of said sheet opposite to said shutter, and wherein, after having held down the end of said sheet by said flapper, a next sheet is superimposed over said sheet with ends thereof.

* * * * *

UNITED STATES PATENT AND TRADEMARK OFFICE

CERTIFICATE OF CORRECTION

PATENT NO. : 6,908,078 B2
DATED : June 21, 2005
INVENTOR(S) : Toshimasa Suzuki et al.

It is certified that error appears in the above-identified patent and that said Letters Patent is hereby corrected as shown below:

Column 5,
Line 14, “forms” should read -- form --.

Column 6,
Line 1, “reference 9” should read -- reference numeral 9 --.
Line 9, “FIG.” should read -- FIGS. --.
Line 25, “a” (1st occurrence) should be deleted.; and “turns” should read -- turn --.
Line 26, “a” should be deleted.

Column 7,
Line 24, “retreat” should read -- retreats --.
Line 27, “turns” should read -- turn --.
Line 28, “is” should read -- are --.
Line 45, “illustrates” should read -- illustrate --.

Column 8,
Line 33, “is” should read -- are --.

Signed and Sealed this

First Day of November, 2005

JON W. DUDAS
*Director of the United States Patent and Trademark Office*